US006530815B1

(12) United States Patent
Bro et al.

(10) Patent No.: US 6,530,815 B1
(45) Date of Patent: Mar. 11, 2003

(54) BUBBLE TUMBLER

(75) Inventors: Jay M. Bro, St. Helena, CA (US); Daniel Seifert, Albany, CA (US); Terry J. Sanchez, Vacaville, CA (US); Syed J. Hasan, San Ramon, CA (US); Martin J. Hirsch, Chicago, IL (US)

(73) Assignee: Oddzon, Inc., Pawtucket, RI (US)

( * ) Notice: Subject to any disclaimer, the term of this patent is extended or adjusted under 35 U.S.C. 154(b) by 0 days.

(21) Appl. No.: 09/576,154

(22) Filed: May 22, 2000

(51) Int. Cl.[7] ..... A63H 33/28; A63H 15/06; A63H 13/18; A63H 23/08

(52) U.S. Cl. ..... 446/15; 446/267; 446/325; 446/396

(58) Field of Search ..... 446/324, 325, 446/326, 396, 15, 16, 17, 18, 19, 20, 21

(56) References Cited

U.S. PATENT DOCUMENTS

| | | | | | |
|---|---|---|---|---|---|
| 676,924 | A | | 6/1901 | Steiger, Jr. | |
| 907,092 | A | * | 12/1908 | Schoenhut | 446/326 |
| 1,210,397 | A | | 1/1917 | Bang | |
| 1,425,945 | A | * | 8/1922 | Congdon | 446/396 |
| 2,052,496 | A | | 8/1936 | Stassi | |
| 2,414,697 | A | | 1/1947 | Pettersson | |
| 2,601,767 | A | | 7/1952 | Wall | |
| 2,810,491 | A | | 10/1957 | Goldschmidt | |
| 3,579,898 | A | * | 5/1971 | Hein | 446/16 |
| 3,781,164 | A | | 12/1973 | McCaffery | |
| 3,818,627 | A | | 6/1974 | Lebensfeld | |
| 3,845,583 | A | * | 11/1974 | Ziff | 446/17 |
| 3,877,614 | A | | 4/1975 | Murphy | |
| 4,170,237 | A | | 10/1979 | Epstein | |
| 4,180,938 | A | | 1/1980 | LaFata et al. | |
| 4,241,741 | A | | 12/1980 | Cabados et al. | |
| 4,770,649 | A | | 9/1988 | Cuccio | |
| 4,840,597 | A | | 6/1989 | Perez | |
| 4,869,390 | A | | 9/1989 | Kennedy | |
| 4,995,844 | A | * | 2/1991 | McNett et al. | 446/21 |
| 5,022,559 | A | | 6/1991 | Condon | |
| 5,088,950 | A | | 2/1992 | LaFata | |
| 5,105,975 | A | | 4/1992 | Patterson | |
| 5,169,354 | A | | 12/1992 | Norton et al. | |
| 5,183,428 | A | * | 2/1993 | Lin | 446/15 |
| 5,304,085 | A | * | 4/1994 | Novak | 446/15 |
| 5,653,620 | A | * | 8/1997 | Lin | 446/15 |
| RE36,131 | E | | 3/1999 | Schramm | |
| 6,132,125 | A | * | 10/2000 | Lin | 446/16 |
| 6,135,842 | A | * | 10/2000 | LaFata | 446/15 |

* cited by examiner

*Primary Examiner*—Jacob K. Ackun
*Assistant Examiner*—Faye Francis
(74) *Attorney, Agent, or Firm*—Marshall, Gerstein & Borun

(57) ABSTRACT

A bubble-blowing apparatus for use in blowing bubbles from bubble solution may be provided with a bubble solution container capable of holding a volume of bubble solution and having a rounded bottom surface and a container side wall that at least partially defines an interior volume. The container may have a weight distribution, when the internal volume of the container is at least partially filled with bubble solution, that causes the container to automatically move to an upright position from a tilted position angularly displaced from the upright position. The apparatus may also be provided with a cap member that is capable of being attached to the bubble solution container and a bubble wand having a bubble-blowing orifice disposed therein.

21 Claims, 2 Drawing Sheets

BUBBLE TUMBLER

BACKGROUND OF THE INVENTION

The present invention relates to a bubble-blowing apparatus having a container for bubble solution and a bubble wand.

Various types of bubble-blowing devices have been described in previous patents. For example, U.S. Re. Pat. No. 36,131 to Schramm discloses a spill-resistant bubble solution container having a bottle, a cap that may be threadably connected to a neck portion of the bottle, a tube that extends downwardly from an area adjacent the cap, and a bubble wand.

U.S. Pat. No. 4,869,390 to Kennedy discloses a spill-proof container having a generally cylindrical cup, a cap that may be threadably connected to a neck portion of the cup, and a tube that may be removably connected to the cap. When the tube is connected to the cap so that the tube extends in a downward direction, the tube helps prevent spillage of liquid from in side the container, assuming the cup is not filled beyond a predetermined volume. The tube may also be connected to the cap so that the tube extends upwardly from the cap.

SUMMARY OF THE INVENTION

In one aspect, the invention is directed to a bubble-blowing apparatus for use in blowing bubbles from bubble solution. The bubble-blowing apparatus may be provided with a bubble solution container capable of holding a volume of bubble solution and having a rounded bottom surface and a container side wall that at least partially defines an interior volume. The container may have a weight distribution, when the internal volume of the container is at least partially filled with bubble solution, that causes the container to automatically move to an upright position from a tilted position angularly displaced from the upright position. The apparatus may also be provided with a cap member that is capable of being attached to the bubble solution container and a bubble wand having a bubble-blowing orifice disposed therein.

The cap member may include a top portion having an opening disposed therein and a tube that surrounds the opening disposed in the top portion of the cap member. The tube may extend downwardly from the top portion of the cap member into the bubble solution container when the cap member is attached to the bubble solution container.

In another aspect, the invention is directed to an apparatus for holding bubble solution from which bubbles can be generated. The apparatus may be provided with a bubble solution container capable of holding a volume of bubble solution and having a rounded bottom surface and a container side wall that at least partially defines an interior volume. The container side wall may have a portion that is spaced from the rounded bottom surface so that the side wall portion at least partially defines a centrally located three-dimensional space within the interior volume and so that an outer three-dimensional space is disposed between the side wall portion and the rounded bottom surface.

The outer space may be shaped so that it is not disposed within the interior volume and is not occupied by bubble solution when bubble solution is disposed in the container. The container may have a weight distribution, when the internal volume of the container is at least partially filled with bubble solution, that causes the container to automatically move to an upright position from a tilted position angularly displaced from the upright position, such as either 30 degrees or 45 degrees relative to vertical. The apparatus may also be provided with a cap member that is capable of being attached to the bubble solution container.

The features and advantages of the present invention will be apparent to those of ordinary skill in the art in view of the detailed description of the preferred embodiment, which is made with reference to the drawings, a brief description of which is provided below.

DETAILED DESCRIPTION OF VARIOUS EMBODIMENTS

Figure 1:
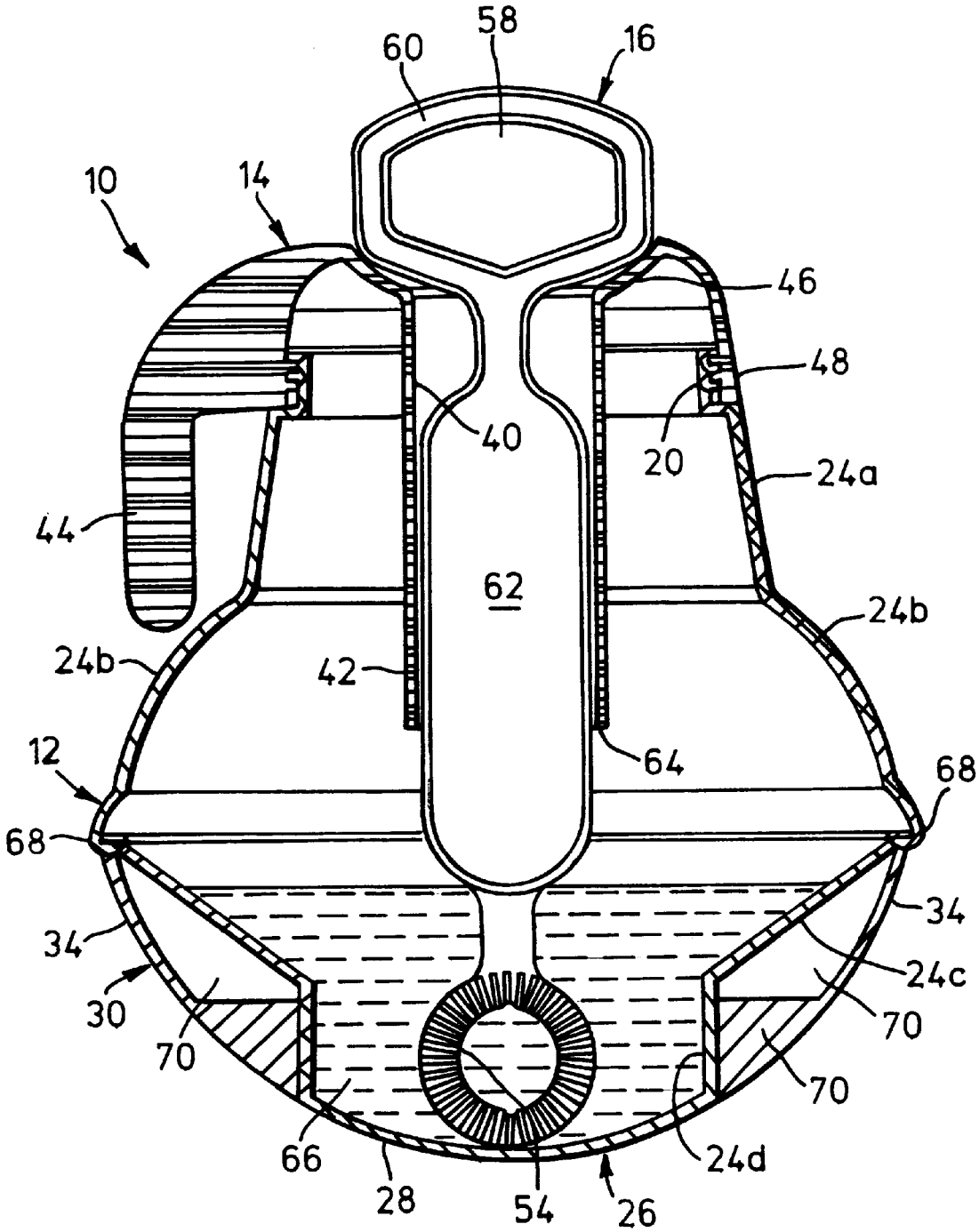
FIG. 1 is a side view, shown partly in cross section, of an embodiment of a bubble-blowing apparatus in accordance with the invention.
Figure 2:
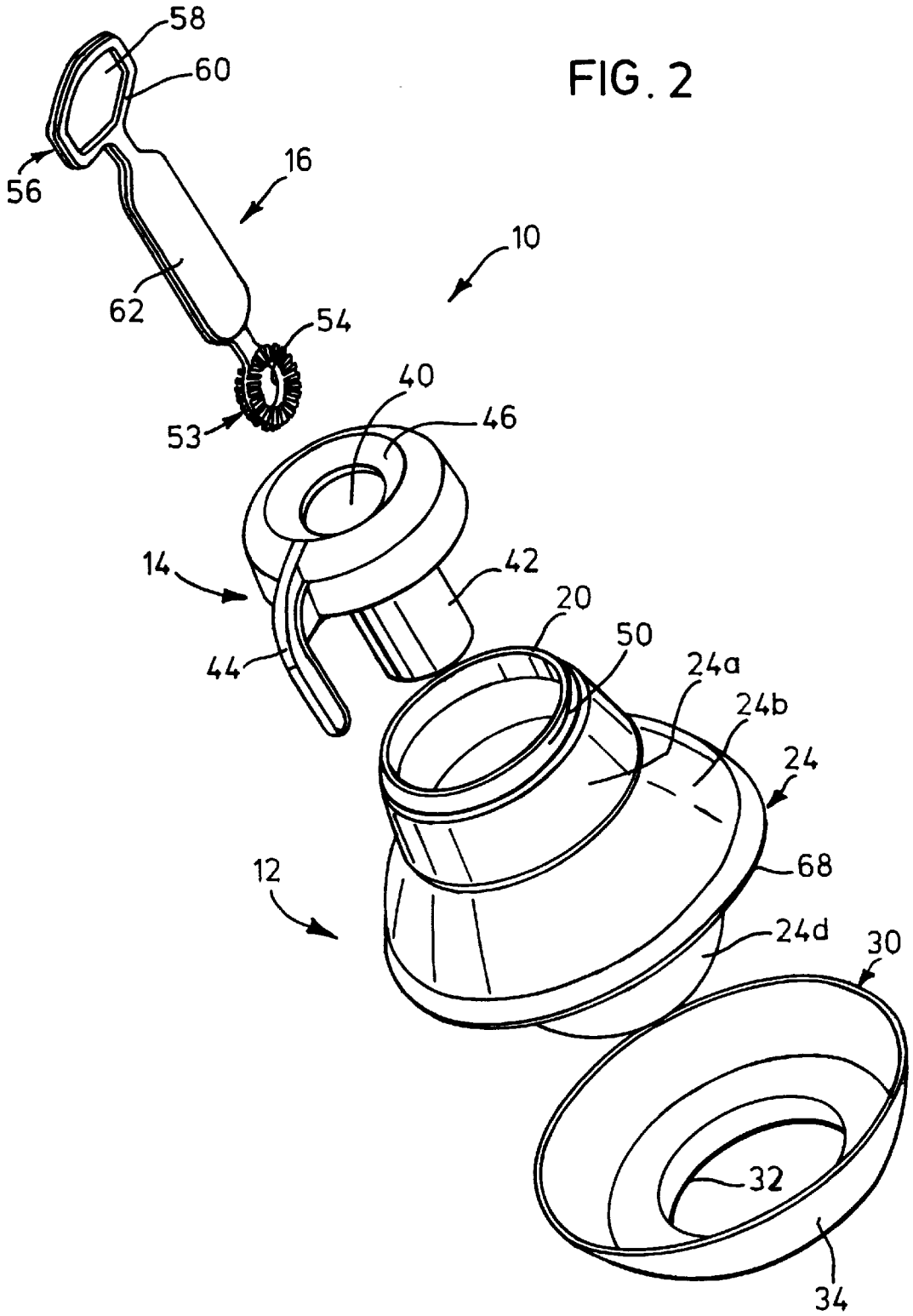
FIG. 2 is an exploded perspective view of the apparatus of FIG. 1.

FIGS. 1 and 2 illustrate an embodiment of a bubble-blowing apparatus 10 in accordance with the invention. Referring to FIGS. 1 and 2, the bubble-blowing apparatus 10 may be provided with three principal components, including a bubble solution container 12, a cap member 14 that is capable of being attached to the container 12, and a bubble wand 16. The bubble solution container 12 has a neck portion 20 having an opening 22 formed therein, a side wall 24 and a rounded bottom wall 26. All portions of the bubble solution container 12 may be composed of plastic.

The side wall 24, which may be rotationally symmetric about a vertical axis passing through the center of the apparatus 10, may have an upper side wall portion 24*a* that is cylindrically or conically shaped, a middle side wall portion 24*b* that is spherically shaped or curved, a lower portion 24*c* that is conically shaped, and a bottom portion 24*d* that is cylindrically shaped. The bottom wall 26, which may be integrally formed with the side wall 24, may have a lower surface 28 with an overall shape that is rounded to allow the bubble solution container 12 to tip or rock back and forth relative to vertical.

The bubble solution container 12 may be provided with a bottom portion or member 30, which can be a separate piece or integrally formed with the other portions of the container 12. The bottom member 30 may be annular in shape and may be provided with a hole or aperture 32 in its center portion, with the aperture 32 being sized to facilitate insertion of the bottom wall 26 therein. If provided as a separate piece, the bottom member 30 may be permanently attached to the bubble solution container 12, such as by adhesive, ultrasonic welding, or a snap-fit connection.

The bottom member 30 may be provided with a generally annular bottom surface 34, which may be smoothly rounded. With the bottom member 30 attached to the container 12, the rounded bottom surface 28 of the bottom wall 26 and the rounded bottom surface 34 of the bottom member 30 may together form a single rounded surface that is smooth and that does not have any discontinuities therein. Alternatively, the bottom member 30 may be provided without the hole 32, in which case the bottom member 30 could cover the bottom wall 26. In that case, the bottom wall 26 could be provided with a flat or other surface while still retaining the ability of the container 12 to rock back and forth.

The cap member 14 may be provided with a top portion having a hole 40 formed therein and a tube 42 that surrounds the hole 40 and extends downwardly from the top portion of the cap member 14. The tube 42, which may be cylindrical in shape, may be integrally formed with the cap member 14. The cap member 14 may be provided with a handle 44, which may be integrally formed with the cap member 14. The top portion of the cap member 14 may be provided with an annular surface or wall portion 46 that slopes downwardly from a peripheral area of the top portion of the cap member 14 to the hole 40. The cap member 14 may be provided with a threaded portion 48, which may be in the form of one or more screw threads, that is shaped to allow the cap member 14 to be attached to the container 12 via a similar threaded portion 50 disposed around the neck 20 of the container 12.

The bubble wand 16 may be provided with a first end having a bubble-blowing ring 53 with only a single orifice 54 disposed therein and a second end having a handle portion 56. The handle portion 56 may comprise a solid surface 58 that is recessed relative to a raised handle perimeter 60. The bubble wand 16 may be provided with a body portion 62 disposed between its ends, and the body portion 62 and the bubble-blowing ring 53 may be sized so that they are small enough to pass through the opening 40 in the cap member 14 and through the tube 42.

Referring to FIG. 1, when the cap member 14 is threadably attached to the bubble solution container 12, the tube 42 extends downwardly into the interior of the container 12. The end 64 of the tube 42 may be disposed at an elevation that is disposed between the conical side wall portion 24*c* and the upper side wall portion 24*a*. As shown in FIG. 1, bubble solution 66 contained by the container 12 may completely fill a cylindrically shaped internal volume of the container 12 that is at least partially defined by the side wall portion 24*d*. Bubble solution 66 may also partially or completely fill a conically shaped internal volume of the container 12 that is at least partially defined by the side wall portion 24*c*.

If bubble solution 66 is added to the container 12 so that the upper level of the bubble solution 66 does not substantially extend above a certain fill point, such as a fill point generally coinciding with an outer circumferential edge 68 of the container 12, the tube 42 may act to prevent bubble solution 66 from spilling out of the container 12 when the container 12 is tipped or even turned completely upside down. Such spillage will be prevented since, if the container 12 is turned upside down, the level of the bubble solution will not rise above the edge 64 of the now-inverted tube 42 and since the seal between cap member 14 and the container 12 is substantially liquid tight.

Still referring to FIG. 1, when the bubble solution container 12 is filled with bubble solution 66 so that the bubble solution 66 at least partially occupies the internal volume defined by the cylindrical side wall portion 24*d*, the bubble solution container 12 has a weight distribution that causes it to remain in an upright position, despite its rounded bottom surface 28, and allows the container 12 to rock back and forth or wobble on its rounded bottom surface 28 without falling over. That weight distribution is influenced at least partially by a generally annular space 70 (which may be occupied by air or other material) disposed between the rounded bottom surface 34 of the bottom member 30 and the side wall portions 24*c*, 24*d*.

In operation, the bubble solution container 12 is partially filled with bubble solution, which may be accomplished by unthreading the cap member 14 from the container 12 (or leaving the cap member 14 on) and pouring bubble solution into the container 12. The bubble solution may be provided in a separate supply container (not shown) having a volume no greater than the preferred fill volume of the bubble solution container 12, so that when the entire contents of the supply container are poured into the bubble solution container 12, the bubble solution will not surpass the fill level, described above, so that bubble solution will not spill when the apparatus 10 is tilted or inverted.

With the bubble solution container 12 filled, the cap member 14 may then be threaded onto the container 12, and then the bubble wand 16 may be inserted into the container 12 through the opening 40 in cap member 14 and the tube 42 so that the bubble-blowing ring 53 on the lower end of the bubble wand 16 is completely immersed in the bubble solution 66 so that a film of bubble solution is formed over the bubble wand orifice 54 when the bubble wand 16 is withdrawn from the container 12, from which bubbles can be formed.

The bubble solution container 12 may be provided with a weight distribution that causes the container 12 to remain upright after it is angularly displaced 30 or 45 degrees relative to vertical when the container 12 does not have any bubble solution disposed therein.

Modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A bubble-blowing apparatus for use in blowing bubbles from bubble solution, said bubble-blowing apparatus comprising:

a bubble solution container capable of holding a volume of bubble solution, said bubble solution container comprising:

an annular neck having a circular opening formed therein;

a threaded portion disposed on said annular neck;

a rounded bottom surface; and a container side wall that operatively interconnects said rounded bottom surface and said annular neck, said container side wall at least partially defining an interior volume, said container side wall having a portion that is spaced from said rounded bottom surface so that said side wall portion at least partially defines a centrally located three-dimensional space within said interior volume and so that an outer three-dimensional space is disposed between said side wall portion and said rounded bottom surface, said outer space not being disposed within said interior volume and not being occupied by bubble solution when bubble solution is disposed in said container, said container having a weight distribution when said internal volume of said container is at least partially filled with bubble solution, said weight distribution causing said container to automatically move to an upright position from a tilted position angularly displaced from said upright position;

a cap member that is capable of being attached to said bubble solution container, said cap member comprising:

a threaded portion that is shaped to be coupled to said threaded portion of said bubble solution container;

a top portion having an opening disposed therein; and a tube that surrounds said opening disposed in said top portion of said cap member, said tube extending downwardly from said top portion of said cap member into said bubble solution container when said cap member is attached to said bubble solution container; and a bubble wand having a first end and a second end, said first end of said bubble wand having a bubble-blowing orifice disposed therein and said second end of said bubble wand having a handle portion associated therewith, said first end of said bubble wand being sized so that said first end of said bubble wand is capable of passing through said opening disposed in said top portion of said cap member and through said tube so that said first end of said bubble wand can be submerged in bubble solution when said container is filled with a volume of bubble solution and when said first end of said bubble wand is passed through said opening in said top portion of said cap and said tube.

2. An apparatus as defined in claim 1 wherein said side wall is integrally formed with a bottom wall and wherein said bottom surface comprises an outer side of said bottom wall.

3. An apparatus as defined in claim 1 wherein said bubble solution container has a central vertical axis and wherein said container side wall has a shape that is rotationally symmetric about said central vertical axis.

4. An apparatus as defined in claim 1 wherein said bubble wand has only a single bubble-blowing orifice formed therein.

5. An apparatus as defined in claim 1 wherein said tilted position is angularly offset from said upright position by at least about 30 degrees relative to vertical.

6. An apparatus as defined in claim 1 wherein said tilted position is angularly offset from said upright position by at least about 45 degrees relative to vertical.

7. An apparatus as defined in claim 1 wherein said centrally located space comprises a cylindrically shaped space and wherein said outer space comprises an annularly shaped space.

8. A bubble-blowing apparatus for use in blowing bubbles from bubble solution, said bubble-blowing apparatus comprising:

a bubble solution container capable of holding a volume of bubble solution, said bubble solution container comprising:

a neck having an opening formed therein;

a rounded bottom surface; and a container side wall that operatively interconnects said rounded bottom surface and said neck, said container side wall at least partially defining an interior volume, said container side wall having a portion that is spaced from said rounded bottom surface so that said side wall portion at least partially defines a centrally located three-dimensional space within said interior volume and so that an outer three-dimensional space is disposed between said side wall portion and said rounded bottom surface, said outer space not being disposed within said interior volume and not being occupied by bubble solution when bubble solution is disposed in said container and said outer space surrounding said centrally located space, said container having a weight distribution when said internal volume of said container is at least partially filled with bubble solution, said weight distribution causing said container to automatically move to an upright position from a tilted position angularly displaced from said upright position;

a cap member that is capable of being attached to said bubble solution container, said cap member comprising:

a top portion having an opening disposed therein; and a tube that surrounds said opening disposed in said top portion of said cap member, said tube extending downwardly from said top portion of said cap member into said bubble solution container when said cap member is attached to said bubble solution container; and a bubble wand having a first end and a second end, said first end of said bubble wand having a bubble-blowing orifice disposed therein and said second end of said bubble wand having a handle portion associated therewith, said first end of said bubble wand being sized so that said first end of said bubble wand is capable of passing through said opening disposed in said top portion of said cap member and through said tube so that said first end of said bubble wand can be submerged in bubble solution when said container is filled with a volume of bubble solution and when said first end of said bubble wand is passed through said opening in said top portion of said cap and said tube.

9. An apparatus as defined in claim 8 wherein said tilted position is angularly offset from said upright position by at least about 30 degrees relative to vertical.

10. An apparatus as defined in claim 8 wherein said tilted position is angularly offset from said upright position by at least about 45 degrees relative to vertical.

11. An apparatus as defined in claim 8 wherein said centrally located space comprises a cylindrically shaped space and wherein said outer space comprises an annularly shaped space.

12. A bubble-blowing apparatus for use in blowing bubbles from bubble solution, said bubble-blowing apparatus comprising:

a bubble solution container capable of holding a volume of bubble solution, said bubble solution container comprising a rounded bottom surface and a container side wall that at least partially defines an interior volume, said bubble solution container having a weight distribution when said internal volume of said container is at least partially filled with bubble solution that causes said container to automatically move to an upright position from a tilted position angularly displaced from said upright position;

a cap member that is capable of being attached to said bubble solution container; and a bubble wand having a first end and a second end, said first end of said bubble wand having a bubble-blowing orifice disposed therein.

13. An apparatus as defined in claim 12 wherein said cap member comprises:

a top portion having an opening disposed therein; and a tube that surrounds said opening disposed in said top portion of said cap member, said tube extending downwardly from said top portion of said cap member into said bubble solution container when said cap member is attached to said bubble solution container.

14. An apparatus as defined in claim 12 wherein said cap member comprises:

a top portion having an opening disposed therein; and a tube that surrounds said opening disposed in said top portion of said cap member, said tube extending downwardly from said top portion of said cap member into said bubble solution container when said cap member is attached to said bubble solution container and wherein said first end of said bubble wand is sized so that said first end of said bubble wand is capable of passing through said opening disposed in said top portion of said cap member and through said tube so that said first end of said bubble wand can be submerged in bubble solution when said container is filled with a volume of bubble solution and when said first end of said bubble wand is passed through said opening in said top portion of said cap and said tube.

15. An apparatus as defined in claim 12 wherein said tilted position is angularly offset from said upright position by at least about 30 degrees relative to vertical.

16. An apparatus as defined in claim 12 wherein said tilted position is angularly offset from said upright position by at least about 45 degrees relative to vertical.

17. An apparatus for holding bubble solution from which bubbles can be generated, said apparatus comprising:

a bubble solution container capable of holding a volume of bubble solution, said bubble solution container comprising a rounded bottom surface and a container side wall that at least partially defines an interior volume, said container side wall having a portion that is spaced from said rounded bottom surface so that said side wall portion at least partially defines a centrally located three-dimensional space within said interior volume and so that an outer three-dimensional space is disposed between said side wall portion and said rounded bottom surface, said outer space not being disposed within said interior volume and not being occupied by bubble solution when bubble solution is disposed in said container, said container having a weight distribution when said internal volume of said container is at least partially filled with bubble solution, said weight distribution causing said container to automatically move to an upright position from a tilted position angularly displaced from said upright position; and a cap member that is capable of being attached to said bubble solution container.

18. An apparatus as defined in claim 17 additionally comprising a bubble wand having a first end and a second end, said first end of said bubble wand having a bubble-blowing orifice disposed therein.

19. An apparatus as defined in claim 17 wherein said tilted position is angularly offset from said upright position by at least about 30 degrees relative to vertical.

20. An apparatus as defined in claim 17 wherein said tilted position is angularly offset from said upright position by at least about 45 degrees relative to vertical.

21. An apparatus as defined in claim 17 wherein said centrally located space comprises a cylindrically shaped space and wherein said outer space comprises an annularly shaped space.

* * * * *